US009511834B2

(12) United States Patent
Nasuno

(10) Patent No.: US 9,511,834 B2
(45) Date of Patent: Dec. 6, 2016

(54) SUBMERSIBLE AND METHOD OF CONTROLLING THE SAME

(71) Applicant: Kunio Nasuno, Tokyo (JP)

(72) Inventor: Kunio Nasuno, Tokyo (JP)

( * ) Notice: Subject to any disclaimer, the term of this patent is extended or adjusted under 35 U.S.C. 154(b) by 0 days.

(21) Appl. No.: 14/892,040

(22) PCT Filed: May 27, 2013

(86) PCT No.: PCT/JP2013/003330

§ 371 (c)(1),
(2) Date: Nov. 18, 2015

(87) PCT Pub. No.: WO2014/192038

PCT Pub. Date: Dec. 4, 2014

(65) Prior Publication Data

US 2016/0107735 A1 Apr. 21, 2016

(51) Int. Cl.
*B63G 8/22* (2006.01)
*B63G 8/26* (2006.01)

(52) U.S. Cl.
CPC .. *B63G 8/22* (2013.01); *B63G 8/26* (2013.01)

(58) Field of Classification Search
CPC ..... B63G 8/00; B63G 8/16; B63G 8/22; B63G 8/24; B63G 8/26
USPC ..... 114/312, 331, 333
See application file for complete search history.

(56) References Cited

U.S. PATENT DOCUMENTS 2,887,977 A * 5/1959 Piry ..... B63G 8/26 114/333
3,301,209 A 1/1967 Caldwell, Jr.

FOREIGN PATENT DOCUMENTS

| | | |
|---|---|---|
| JP | 59-89296 | 5/1984 |
| JP | 61-200090 | 9/1986 |
| JP | 63-43896 | 2/1988 |
| JP | 1-95992 | 4/1989 |

OTHER PUBLICATIONS

International Search Report issued Jul. 9, 2013 in International Application No. PCT/JP2013/003330.

* cited by examiner

*Primary Examiner* — Lars A Olson
(74) *Attorney, Agent, or Firm* — Wenderoth, Lind & Ponack, L.L.P.

(57) ABSTRACT

A submersible designed so that a cabin for boarding an operator has a size just enough to accommodate the operator and even such a light weight of the submersible can cause the submersible to submerge. Furthermore, when an operator having a weight smaller than a design maximum operator's weight of the submersible is on board, and therefore the total weight of the submersible is reduced and the buoyancy thereof is increased, the buoyancy of the submersible is adjusted by pouring water having a weight corresponding to a difference between the design maximum operator's weight and the actual weight of the operator into an expansion container, disposed in the cabin, capable of expanding by containing water. In this manner, the net weight of the submersible is prevented from increasing.

9 Claims, 13 Drawing Sheets

SUBMERSIBLE AND METHOD OF CONTROLLING THE SAME

TECHNICAL FIELD

The present invention relates to a submersible, a structure of the submersible, and a method of controlling the same.

BACKGROUND ART

In recent years, construction of small submersibles has been increasing along with the popularization of marine leisure. However, existing submersibles are heavy and therefore a truck with a large crane or a large ship is necessary for transporting such a submersible. Under current conditions, it is difficult to operate such submersibles and special training needs to be received.

SUMMARY OF INVENTION

Solution to Problem

In order to solve the above problem, a submersible according to the present invention is designed so that a cabin for boarding an operator has a size just enough to accommodate the operator and even the net weight of such a light submersible can cause the submersible to submerge.

Furthermore, when an operator having a weight smaller than a design maximum operator's weight of the submersible is on board and therefore the total weight of the submersible is reduced and the buoyancy thereof is increased, the buoyancy of the submersible is adjusted by pouring water having a weight corresponding to a difference between the design maximum operator's weight and the actual weight of the operator into an expansion container, disposed in the cabin, capable of expanding by containing water. This causes the submersible to submerge without increasing the net weight of the submersible. In addition, in order to solve the lack of oxygen in the cabin, which is caused by the size reduction of the cabin, this submersible includes an apparatus for preventing a passenger from having a shortage of oxygen by compressing remaining old air by a pump and discharging the compressed air to the outside of the submersible from an area farthest from the mouth of the operator in the cabin and by supplying fresh air from an air supply unit to the mouth of the operator while adjusting air pressure through an air pressure regulator.

This submersible is designed to allow for easy ascent, neutral, and descent operations even when an obstacle is present therearound only by providing an ascent and descent tank and pushing an ascent setting, neutral setting, or descent setting switch in an operating unit without operating an elevator or a screw of the submersible for forward and backward movements.

Advantageous Effects of Invention

According to the present invention, the reduced weight of the submersible allows for the transportation thereof by towing a simple trailer loading the submersible with a passenger car. Without requiring a truck with a special crane or a large ship, it is possible to transport the submersible readily. Furthermore, its easy operation can lead to providing the pleasure of underwater world to more people. According to the submersible of the present invention, a tank for regulating the buoyancy of the submersible to zero at the start of submergence and the ascent and descent tank for setting the ascent setting, the descent setting, and the neutral setting in the operating unit in the midst of submergence are separately provided. Thus, it is possible to simplify regulating operations required for submergence at a desired submergence depth in the midst of submergence. It is also possible to shorten an amount of time that elapses before the submergence at the desired submergence depth is achieved. Furthermore, since the submersible can ascend only by turning on the ascent switch, the submersible can easily get out of a trough or a narrow space without needing operations for inclining or moving the submersible forward or backward. The present invention can provide the submersible that is easy to operate and highly safe.

DESCRIPTION OF EMBODIMENTS

First Embodiment

Figure 1:
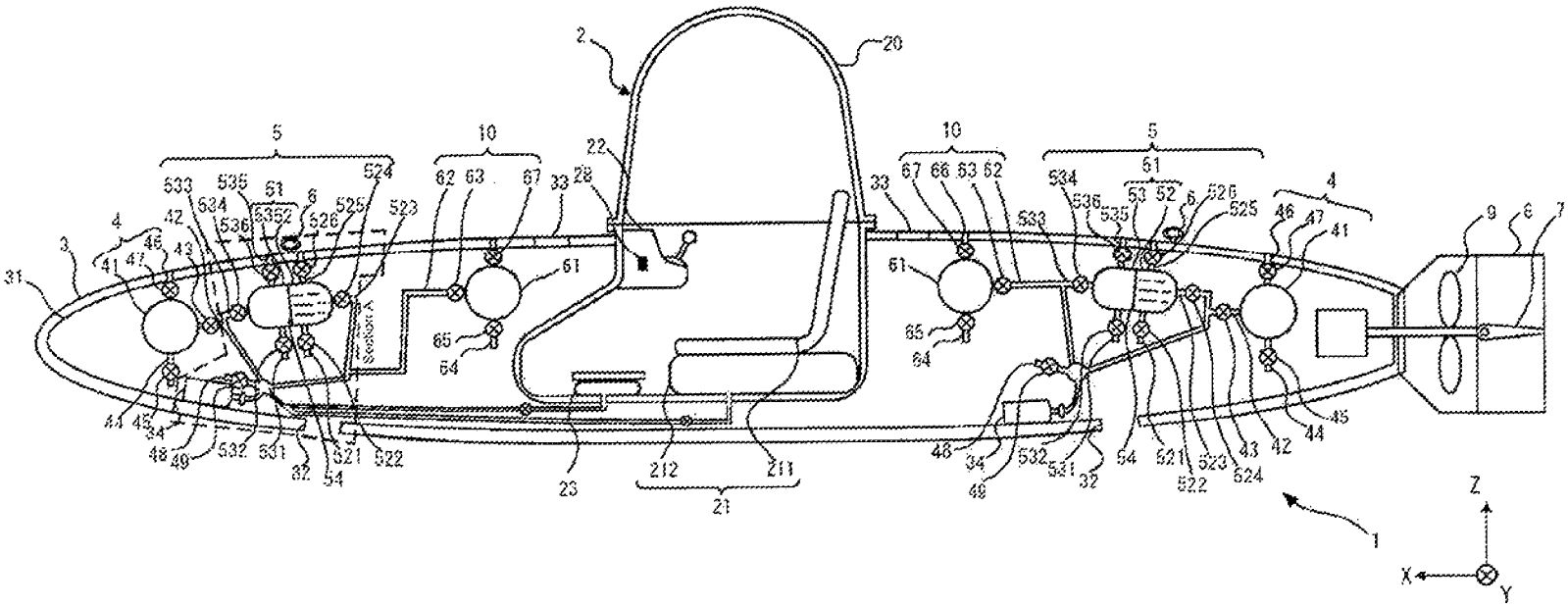
FIG. 1 is a schematic view of a submersible according to a first embodiment of the present invention.
Figure 3:
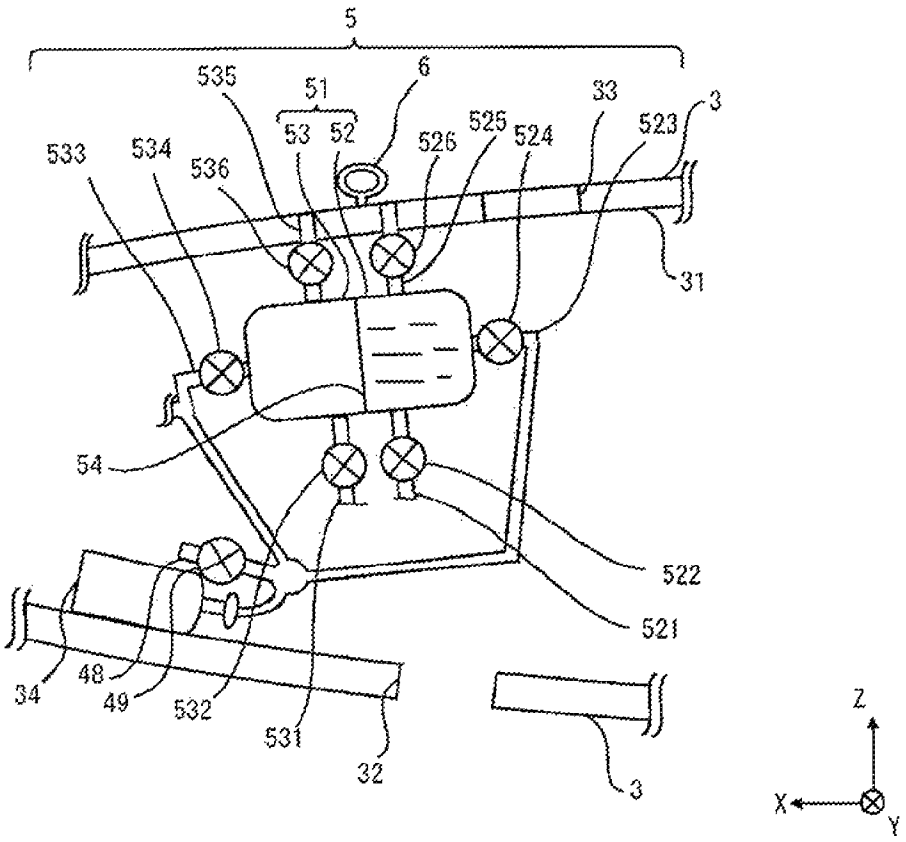
FIG. 3 is an enlarged view illustrating a section A of the submersible in FIG. 1.

A best mode for carrying out the present invention will be described next with reference to the drawings. FIG. 1 is a schematic view of a submersible 1 according to the first embodiment of the present invention. FIG. 3 is an enlarged view of a section A of the submersible 1 indicated by a dotted line in FIG. 1. Note that the directions of forward and backward movements of the submersible 1 are defined as the x-axis, the right and left directions of the submersible 1 as the y-axis, and the surfacing and submerging (sinking) directions of the submersible 1 as the z-axis.

As shown in FIG. 1, the submersible 1 includes: a cabin 2 for boarding an operator; a first tank 31 constituting a body 3 of the submersible 1 and configured to lower buoyancy by inflow of seawater or freshwater (hereinafter referred to as water) at the time of submergence; a second tank 41 disposed inside the first tank 31; a first water supply and discharge pipe 44 configured to allow water movement between the outside of the first tank 31 and the second tank 41; and a first air supply pipe 42 configured to allow air movement between a high-pressure air container 34 (air supply unit) for supplying air (gas) and the second tank 41. Note that FIG. 1 illustrates the first water supply and discharge pipe 44 in a partially omitted manner.

The submersible 1 includes: a third tank 61 disposed inside the first tank 31; a second water supply and discharge pipe 64 configured to allow water movement between the outside of the first tank 31 and the third tank 61; and a second air supply pipe 62 configured to allow air movement between the high-pressure air container 34 (air supply unit) for supplying air and the third tank 61. Note that FIG. 1 illustrates the second water supply and discharge pipe 64 in a partially omitted manner.

The submersible 1 further includes: a fourth tank 51 disposed inside the first tank 31 and divided into an ascent tank 52 and a descent tank 53 by a partition plate 54 (partition wall); a third water supply and discharge pipe 521 configured to allow water movement between the outside of the first tank 31 and the ascent tank 52; a third air supply pipe 523 configured to allow air movement between the high-pressure air container 34 and the ascent tank 52; a fourth water supply and discharge pipe 531 configured to allow water movement between the outside of the first tank 31 and the descent tank 53; and a fourth air supply pipe 533 configured to allow air movement between the high-pressure air container 34 and the descent tank 53. Note that FIG. 1 illustrates the third water supply and discharge pipe 521 and the fourth water supply and discharge pipe 531 in a partially omitted manner.

The submersible 1 also includes: an eyebolt 6 for lacing a rope therethrough when the submersible 1 is craned; an elevator 7 for controlling movements of the submersible 1 in the surfacing and submerging directions (the z-axis direction); a rudder 8 for controlling movements of the submersible 1 in the right and left directions (the y-axis direction); and a screw 9 for causing the submersible 1 to move forward and backward. Furthermore, the submersible 1 includes: a first tank air supply pipe 48 configured to allow air in the high-pressure air container 34 to move into the first tank 31; and a first tank air supply valve 49 for regulating an amount of air to move into the first tank 31 via the first tank air supply pipe 48.

As will be described later, in order to cause the submersible 1 to surface, the first air supply valve 49 is opened to discharge air in the high-pressure air container 34 and thereby push out water contained in the first tank 31 through a flood hole 32. In this manner, the weight of the submersible 1 is reduced.

As shown in FIG. 1, the cabin 2 has a dome shape protruded in the z-axis direction. A wall surface of the cabin 2 has a pressure-proof structure to resist water pressure at the time of submergence. An openable and closeable hatch 20 is provided in an upper part of the cabin 2. When an operator boards the cabin 2, the hatch 20 is opened. At the time of submergence, the hatch 20 is closed. Moreover, a seat unit 21 to be seated by an operator and an operating unit 22 used by an operator to operate the submersible 1 are provided inside the cabin 2.

The operating unit 22 is electrically connected with various regulating valves for regulating a trim tank unit 4, a zero-buoyancy setting tank unit 10, and an ascent and descent tank unit 5 to be described later, the elevator 7, the rudder 8, and the screw 9, for example. Moreover, the operating unit 22 includes: a setting unit by which an operator selectively sets one of an ascent setting for causing the submersible 1 to ascend, a descent setting for causing the submersible 1 to descend, and a neutral setting for preventing an ascending movement and a submerging movement of the submersible 1; a display unit for displaying a submergence depth at the time of diving; and a control unit 28 for governing overall control of the submersible 1.

To adjust a submerging attitude of the submersible 1 at the start of submergence, the operating unit 22 of the submersible 1 is operated to select a balance setting. This causes a submersible attitude detecting sensor (not shown) to detect the attitude of the submersible and causes the control unit 28 to adjust a first water supply and discharge valve 45 and a first air discharge valve 47. In this manner, attitude control is performed.

With a submergence depth detecting sensor (not shown) attached to the submersible 1, the depth of the submersible is detected until the submersible 1 reaches to a submergence depth preset in order to set the buoyancy of the submersible to 0 (hereinafter referred to as a specified submergence depth (predetermined submergence depth)). The control unit 28 regulates a second water supply and discharge valve 65 and a second air discharge valve 67 to make the submersible submerged to the specified submergence depth. In this manner, the buoyancy of the submersible 1 is set to 0.

In accordance with the setting (the ascent setting, the neutral setting, and the descent setting) set in the setting unit, the control unit 28 regulates at least one of a third water supply and discharge valve 522, a third air supply valve 524, a third air discharge valve 526, a fourth water supply and discharge valve 532, a fourth air supply valve 534, and a fourth air discharge valve 536.

This causes air and water in the fourth tank 51 to be regulated and thereby allows for the ascending and submerging movements of the submersible 1 in accordance with the setting (the ascent setting, the neutral setting, and the descent setting) in the setting unit.

Here, the ascent setting, the neutral setting, and the descent setting set in the setting unit will be described specifically. If an operator sets anyone of the ascent setting, the neutral setting, and the descent setting in the setting unit after the submersible 1 submerges, the control unit 28 regulates the third water supply and discharge valve 522, the third air supply valve 524, the third air discharge valve 526, the fourth water supply and discharge valve 532, the fourth air supply valve 534, and the fourth air discharge valve 536 to control air and water inside the ascent tank 52 and the descent tank 53 in the ascent and descent tank unit 5 in a state as shown in Table 1 below.

TABLE 1

| STATES IN ASCENT TANK 52 AND DESCENT TANK 53 ACCORDING TO SETTINGS IN SETTING UNIT | | |
|---|---|---|
| SUBMERGENCE DEPTH CHANGING SWITCH | DESCENT TANK | ASCENT TANK |
| ASCENT SETTING | AIR | AIR |
| NEUTRAL SETTING | AIR | WATER |
| DESCENT SETTING | WATER | WATER |

Specifically, when the operator selects the descent setting by operating the setting unit, the control unit 28 opens the fourth water supply and discharge valve 532 and the fourth air discharge valve 536 so that air is discharged from the descent tank 53 and water is caused to flow into the descent tank 53. In this manner, the descent tank 53 is filled with water. When the operator selects the neutral setting from such a state by operating the setting unit, the fourth air discharge valve 536 is closed and the fourth air supply valve 534 is opened. Consequently, air is sent from the high-pressure air container 34 into the descent tank 53 via the fourth air supply pipe, and thus the water in the descent tank 53 is pushed out to the outside of the submersible 1 via the fourth water supply and discharge pipe 531. Thus, the descent tank 53 is filled with the air.

When the operator selects the ascent setting by operating the setting unit, the control unit 28 opens the third water supply and discharge valve 522 and the third air supply valve 524 so that air is caused to flow into the ascent tank 52 and water is discharged from the ascent tank 52 to the outside of the submersible 1. In this manner, the ascent tank 52 is filled with the air. Simply by selecting any one of the ascent setting, the neutral setting, and the descent setting in the setting unit as described above, the submergence depth can be changed. The operator can thus easily perform a change to a desired submergence depth.

Figure 2A:
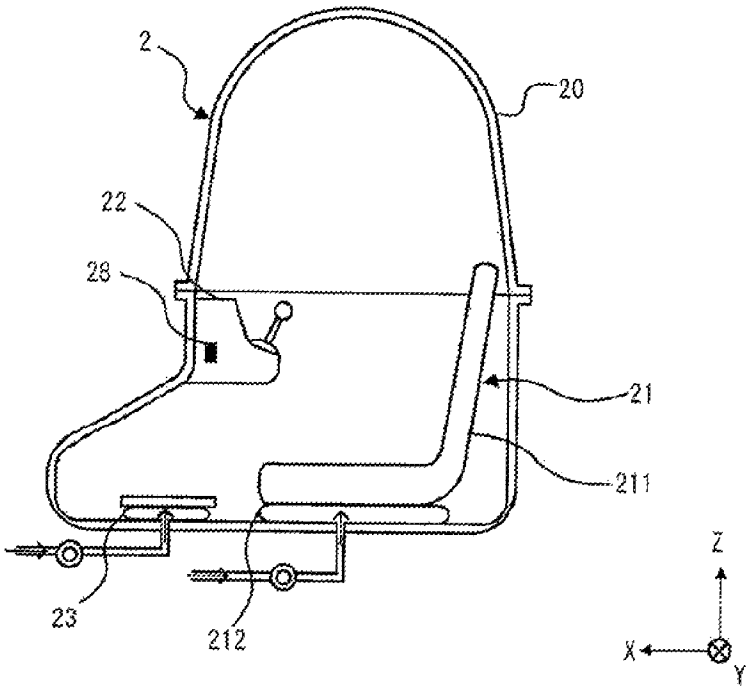
FIG. 2A is a schematic view illustrating a case where an expansion container and a footrest unit in a cabin each contain a small amount of water.
Figure 2B:
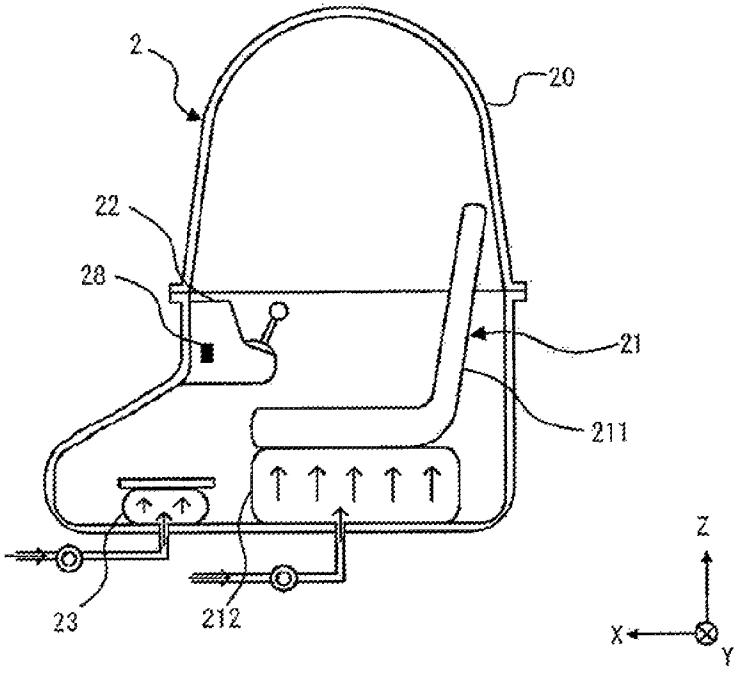
FIG. 2B is a schematic view illustrating a case where the expansion container and the footrest unit in the cabin each contain a large amount of water.

FIG. 2 is a diagram for explaining operations of the seat unit 21. FIG. 2A corresponds to a case where a heavier operator is on board, and FIG. 2B corresponds to a case where a lighter operator is on board. The seat unit 21 may have a configuration including a seat 211 to be seated by an operator and an expansion container 212 that expands so as to push up the seat 211 according to an increase in water supplied thereinto.

Specifically, for a lighter (small physique) operator, more water is introduced into the expansion container 212 as shown in FIG. 2B to increase the total weight of the submersible 1. For a heavier (large physique) operator, on the other hand, less water is introduced into the expansion container 212 as shown in FIG. 2A to reduce the total weight of the submersible 1.

The buoyancy of the submersible 1 can be adjusted by increasing or decreasing water in the expansion container 212 as described above. According to this configuration, once the buoyancy of the submersible 1 is designed in accordance with a maximum design weight (e.g., 100 kg) of an operator for the submersible 1, buoyancy and submerging capability as designed can be obtained only by injecting water corresponding to a weight difference between the maximum design weight and a weight of an operator into the expansion container 212.

More specifically, in order to obtain the buoyancy and submerging capability of the submersible 1 as designed, an operator only needs to weigh oneself before boarding the submersible 1 and inject water corresponding to a weight difference between the maximum weight and one's weight into the expansion container 212. Note that an elastic material, for example, may be used as a material of the expansion container 212.

Furthermore, a footrest unit 23 may be provided in addition to the seat unit 21. In this case, the footrest unit 23 may have a configuration capable of containing water therein as with the seat unit 21.

As shown in FIG. 1, the body 3 has an oval shape with a major axis thereof extending in the x-axis direction, and the cabin 2 is positioned approximately at the center in the x-axis direction. The body 3 is made of a material such as plastic, rubber, or a steel plate, for example. The body 3 and the first tank 31 for containing water at the time of submergence are in common use. The flood hole 32 configured to allow water inflow into the first tank 31 is formed in a lower part of the body 3. A vent 33 configured to allow air discharge from the first tank 31 is provided in an upper part of the body 3. Here, the cabin 2 can be set so that an amount of air therein equals 300 liters. If the submersible is designed as the maximum weight of an operator being 100 kg, an amount of air in the cockpit equals about 200 liters. Therefore, in order to make this submersible submerged below the water surface, the net weight of this submersible can be designed as about 200 kg. Such a configuration allows for easy transportation of this submersible and casual underwater cruise.

As shown in FIG. 1, the trim tank unit 4 includes: the second tank 41; the first air supply pipe 42 for causing air to flow into the second tank 41 from the high-pressure air container 34 filled with high-pressure compressed air; the first water supply and discharge pipe 44 for causing water outside the first tank 31 to flow into and flow out of the second tank 41; and a first air discharge pipe 46 for discharging air contained in the second tank 41 to the outside of the first tank 31.

The trim tank unit 4 further includes: the first water supply and discharge valve 45 for regulating an amount of water in the second tank 41 from the outside of the first tank 31 via the first water supply and discharge pipe 44; a first air supply valve 43 for regulating an amount of air in the second tank 41 from the high-pressure air container 34 via the first air supply pipe 42; and the first air discharge valve 47 for discharging air from the second tank 41 to the outside of the submersible via the first air discharge pipe 46. By opening and closing these first air supply valve 43, the first water supply and discharge valve 45, and the first air discharge valve 47, an amount of water and an amount of air in the second tank 41 can be regulated to achieve the level attitude of the submersible 1.

As shown in FIG. 1, the trim tank units 4 are provided in front of and in the rear of the cabin 2 in the x-axis direction, respectively. In order to lower a bow of the submersible 1, the first air discharge valve 47 and the first water supply and discharge valve 45 of the trim tank unit 4 positioned in front of the cabin 2 are opened to cause water to flow into the trim tank 41 and thereby make the submersible level.

Conversely, in order to lower a stern of the submersible 1, the first air discharge valve 47 and the first water supply and discharge valve 45 of the trim tank unit 4 positioned in the rear of the cabin 2 are opened to cause water to flow into the trim tank 41 and thereby make the submersible level.

As shown in FIG. 3, the ascent and descent tank unit 5 includes the fourth tank 51 having a capsule shape. The inside of the fourth tank 51 is divided into the ascent tank 52 and the descent tank 53 by the partition plate 54. The third water supply and discharge pipe 521, the third air supply pipe 523, and a fourth air discharge pipe 525 are connected to the fourth tank 51. The third water supply and discharge pipe 521 connects between the outside of the first tank 31 and the ascent tank 52. The inside of the ascent tank 52 is filled with water before the start of submergence. The descent tank 53 is filled with air before the start of submergence. Alternatively, the ascent and descent tank unit 5 may be configured by two independent tanks. More specifically, a tank corresponding to the ascent tank 52 and a tank corresponding to the descent tank 53 may be disposed as separate units.

The third air supply pipe 523 connects between the high-pressure air container 34 and the ascent tank 52. The air filled in the high-pressure air container 34 flows into the ascent tank 52 via the third air supply pipe 523.

The third air discharge pipe 525 extends from the ascent tank 52 toward the outside of the first tank 31 for discharging air inside the ascent tank 52 to the outside of the submersible 1. Air to be sent from the high-pressure air container 34 to the ascent tank 52 is controlled via the third air supply valve 524 and the third air supply pipe 523. The third water supply and discharge valve 522 regulates an amount of water to move from the outside of the first tank 31 to the ascent tank 52. The third air discharge valve 526 regulates an amount of air to be discharged from the ascent tank 52 to the outside of the first tank 31.

Moreover, the fourth water supply and discharge pipe 531 for causing water to flow into the descent tank 53 from the outside of the submersible 1, the fourth air supply pipe 533 for causing air to flow into the descent tank 53 from the high-pressure air container 34, and a fourth air discharge pipe 535 for discharging air from the descent tank 53 to the outside of the first tank 31 are connected to the descent tank 53. The third water supply and discharge valve 522, the third air supply valve 524, the third air discharge valve 526, the fourth water supply and discharge valve 532, the fourth air supply valve 534, and the fourth air discharge valve 536 are provided in the middle of the third water supply and discharge pipe 521, the third air supply pipe 523, the third air discharge pipe 525, the fourth water supply and discharge pipe 531, the fourth air supply pipe 533, and the fourth air discharge pipe 535, respectively.

One ends of the third air supply pipe 523 and the fourth air supply pipe 533 are connected to the high-pressure air container 34 to which the first air supply pipe 42 is connected. One ends of the third water supply and discharge pipe 521 and the fourth water supply and discharge pipe 531 are in communication with the outside of the body 3. One ends of the third air discharge pipe 525 and the fourth air discharge pipe 535 are in communication with the outside of the body 3. The air supply pipes, the water supply and discharge pipes, and the air discharge pipes provided separately from each other are connected to the ascent tank 52 and the descent tank 53 in the ascent and descent tank unit 5, respectively, and the valves are provided in these paths. This allows independent control of air and water in the ascent tank 52 and the descent tank 53.

According to the configuration of the present embodiment, the ascent and descent tank unit 5 capable of regulating supply and discharge of air and water is provided separately from the trim tanks disposed on the front and rear sides of the submersible 1 and configured to achieve level balance of the submersible 1 at the start of submergence and the zero-buoyancy setting tanks disposed around the center of the submersible 1 for setting the buoyancy of the submersible to 0. Thus, without changing air amounts and water amounts in the trim tanks and the zero-buoyancy setting tanks, the submergence depth can be easily adjusted only by injecting and discharging air and water in the ascent and descent tank unit 5.

More specifically, without changing air and water amounts in the trim tanks used for regulating the submerging attitude at the start of diving and the zero-buoyancy setting tanks used for setting the buoyancy to 0, only the ascent and descent tank unit 5, which is different from the trim tanks and the zero-buoyancy setting tanks, is regulated. Thus, the present invention can easily make the buoyancy neutral in the midst of diving.

Moreover, to regulate only the submergence depth in the midst of diving, it is only necessary to regulate the presence or absence of air and water in the ascent and descent tank unit 5 without causing the submersible to proceed by the rotation of the screw. Thus, an amount of time that elapses before achieving steady submergence can be shortened without performing a complicated operation up to the desired submergence depth.

Furthermore, according to the submersible 1 of the present embodiment, in changing the desired submergence depth at the start of submergence and the submergence depth in the midst of submergence, the presence or absence of air and water in the ascent and descent tank unit 5 only has to be regulated without the operations of the screw 9, the elevator 7, and the like to cause the submersible to ascend or descend. Especially when ascending from the bottom of the sea, the submersible can avoid stirring up sand or the like. In other words, the submersible 1 of the present embodiment can prevent the visibility of the operator from deteriorating by avoiding the stirring up of sand or the like when ascending from the bottom of the sea. Since fine powder once stirred up takes a very long time to become deposited, such a submersible is very useful in an amusement part in which many submersibles submerge at the same time, for example.

Although the descent tank 53 of the ascent and descent tank unit 5 is positioned on the stern side of the ascent tank 52, the present invention is not limited thereto. The descent tank 53 may be disposed on the bow side of the ascent tank 52. With this configuration, injecting water into the descent tank 53 filled with air at the start of diving can cause the submersible 1 to submerge. Also, injecting air into the ascent tank 52 filled with water at the start of diving can cause the submersible 1 to ascend. In other words, regulating the presence or absence of air and water in the ascent tank 52 and the descent tank 53 in the ascent and descent tank unit 5 can cause the submersible 1 to surface or submerge.

Figure 4:
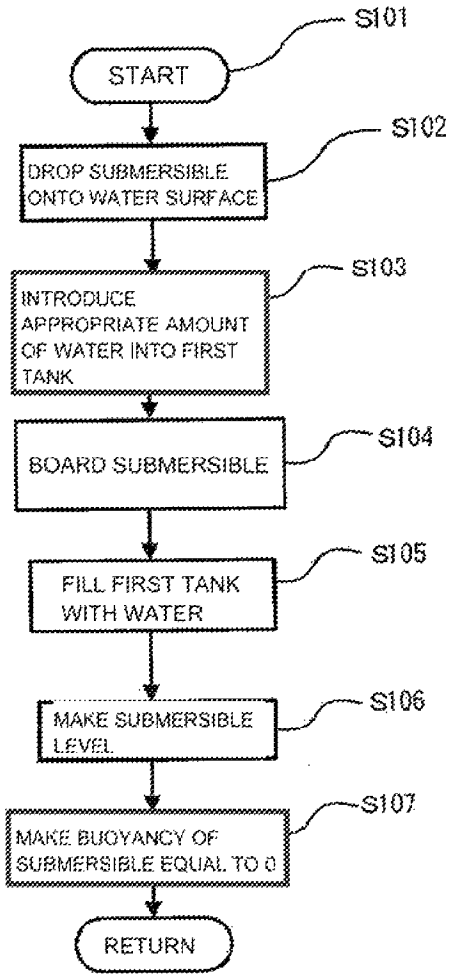
FIG. 4 is a flow chart for the submersible of the present invention at the start of submergence.

A method of starting submergence of the submersible 1 after the landing on the water will be described next with reference to a flow chart shown in FIG. 4. In an initial state for starting the submergence of the submersible 1, it is assumed that the cabin 2, the first tank 31, the second tank 41, the third tank 61, and the descent tank 53 are filled with air, and the ascent tank 52 in the ascent and descent tank unit 5 is filled with water. Moreover, it is assumed that the vent 33 is closed to prevent the inflow of water into the first tank 31.

Furthermore, the first air discharge valve 47, the first water supply and discharge valve 45, the first air supply valve 43, a second air supply valve 63, the second water supply and discharge valve 65, the second air discharge valve 67, the third air supply valve 524, the third water supply and discharge valve 522, the third air discharge valve 526, the fourth air supply valve 534, the fourth water supply and discharge valve 532, and the fourth air discharge valve 536 are closed to prevent the inflow or outflow of air and water into or from the second tank 41, the third tank 61, the ascent tank 52, and the descent tank 53 (S101).

Figure 5A:
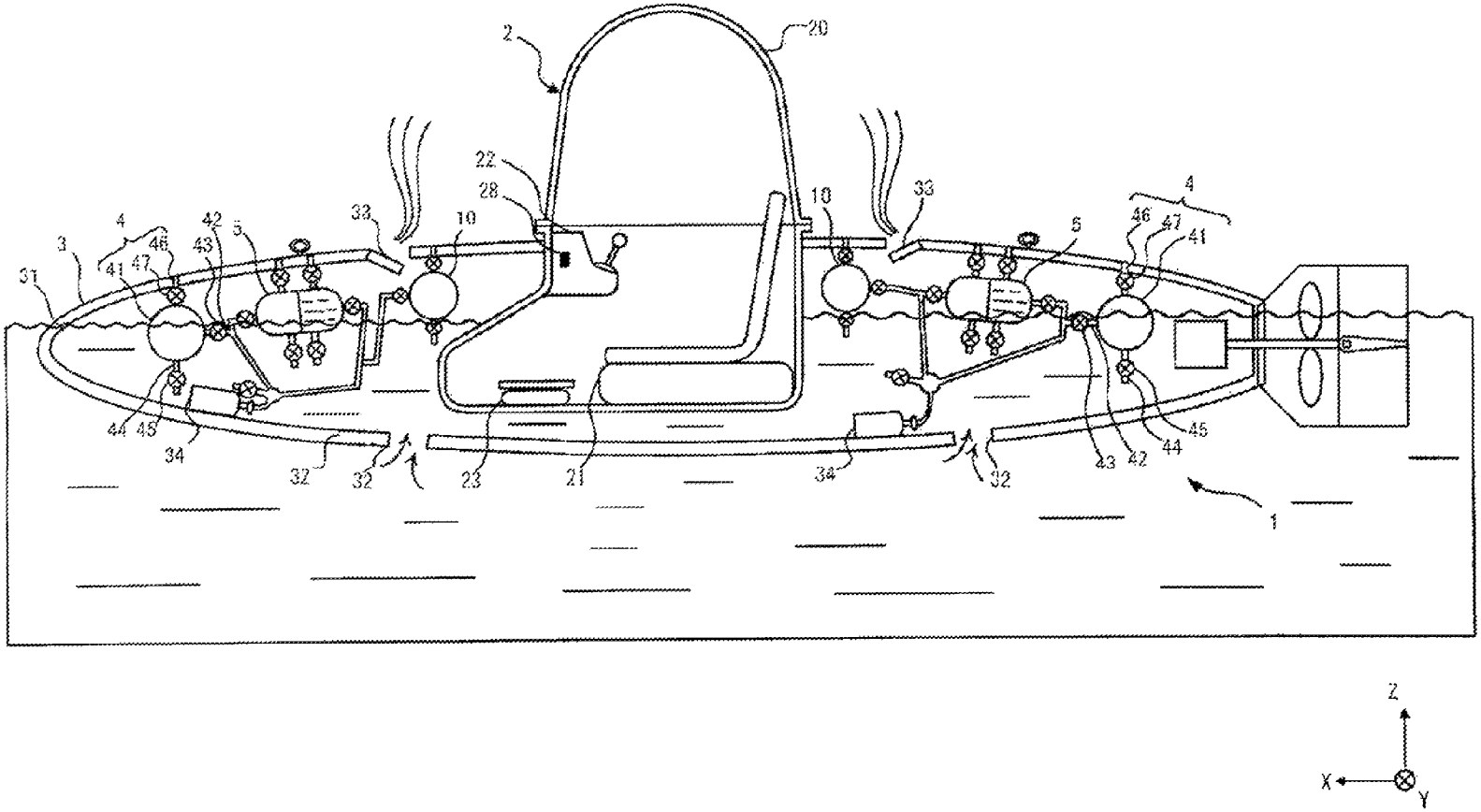
FIG. 5A is a diagram for explaining operations for the submersible of the present invention at the start of submergence.

First, the submersible 1 is dropped onto the water surface (S102). The vent 33 is opened, water is introduced into the first tank 31 until the submersible becomes stable, and the vent 33 is closed (S103). An operator opens the hatch 20 of the submersible 1 and then boards, and introduces water having a weight equal to the value obtained by subtracting the weight of the operator from the specified operator's maximum weight into the expansion container 212. After that, the operator closes the hatch 20 (S104). The operator pushes a vent-opening switch in the setting unit of the operating unit 22 to change the vent 33 of the submersible 1 from a closed state to an open state. This causes air in the first tank 31 to be discharged and causes water to flow into the first tank 31 through the flood hole 32 as shown in FIG. 5A. With the inflow of water into the first tank 31, the submersible 1 gradually submerges into the sea. After the elapse of a predetermined amount of time following the switching of the vent 33 to the open state, the first tank 31 is filled with water. Once the first tank 31 is filled with water, the vent 33 is switched from the open state to the closed state as shown in FIG. 5B (S105).

When a trim button of the submersible is pushed, the control unit 28 determines if a level state is achieved or not on the basis of a detection result by a fore-and-aft balance detecting sensor of the submersible. When the control unit 28 determines that the submerging attitude is not in the level state, the control unit 28 switches the first water supply and discharge valve 45 and the first air discharge valve 47 positioned on either front or rear side to the open state as shown in FIG. 5C to discharge air contained in the trim tank 41 to the outside and cause water to flow into the trim tank 41.

Figure 5B:
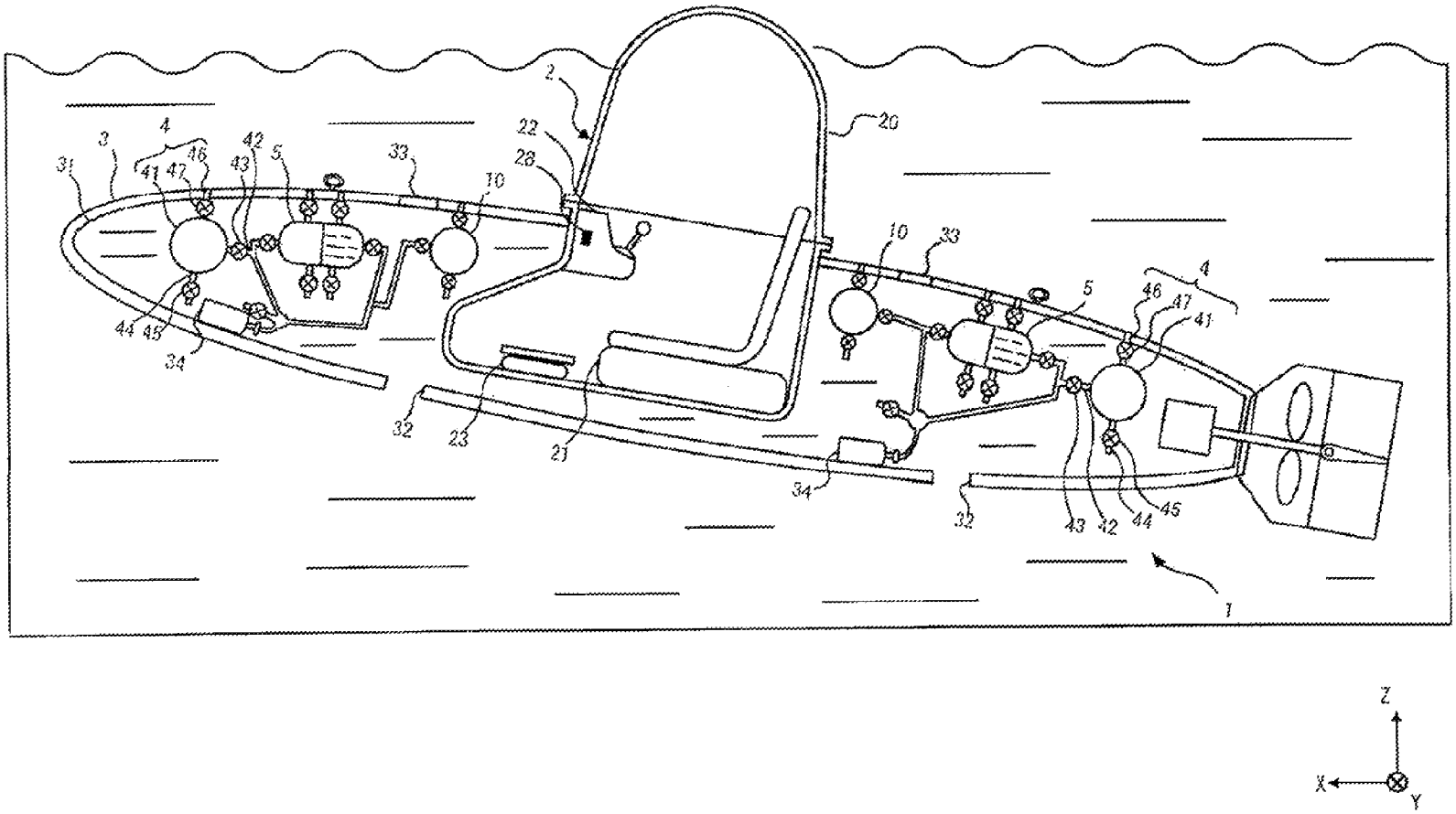
FIG. 5B is a diagram for explaining operations before the submersible of the present invention regulates a trim tank unit at the time of submergence.
Figure 5C:
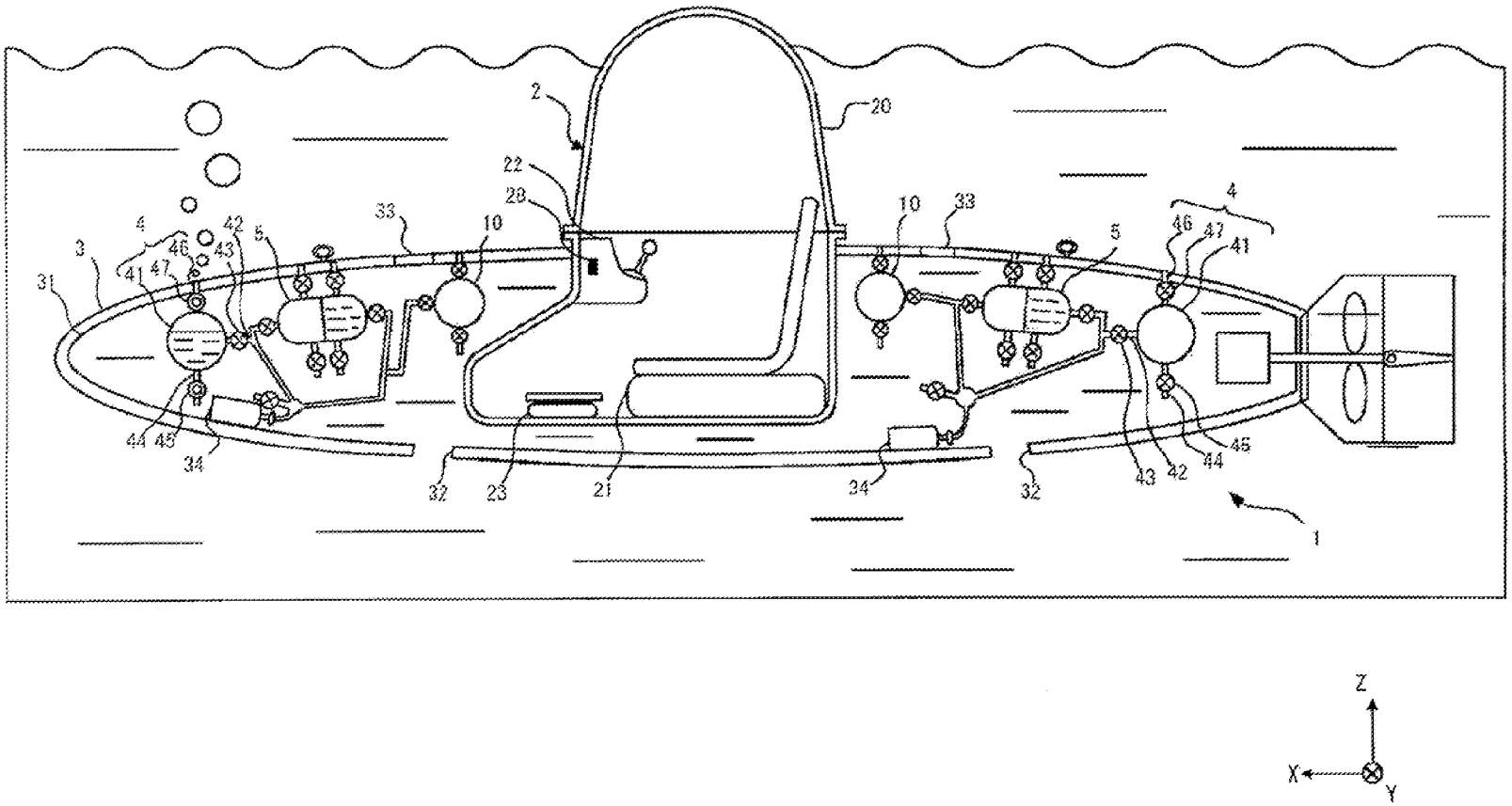
FIG. 5C is a diagram for explaining operations in a state where the submersible of the present invention keeps fore-and-aft level balance by regulating the trim tank unit at the time of submergence.

Specifically, when the control unit 28 determines that the bow of the submersible 1 is tilted more than the stern thereof as shown in FIG. 5B, the control unit 28 adjusts the bow and the stern of the submersible 1 so as to be level with each other by causing water to move into the trim tank 41 on the bow side via the first water supply and discharge pipe 44 as shown in FIG. 5C (S106). When the submerging attitude of the submersible 1 achieves the level state, a zero-buoyancy setting switch in the setting unit of the operating unit 22 is pushed. The control unit 23 determines if a value detected by the submergence depth detecting sensor (hereinafter, referred to as a current submergence depth) is shallower or deeper than the specified submergence depth. The control unit 28 adjusts the second air discharge valve 67 and the second water supply and discharge valve 65 to cause water to flow into the zero-buoyancy setting tank 61 until the specified submergence depth is reached. In this manner, the submersible 1 is caused to submerge in the water.

Figure 5D:
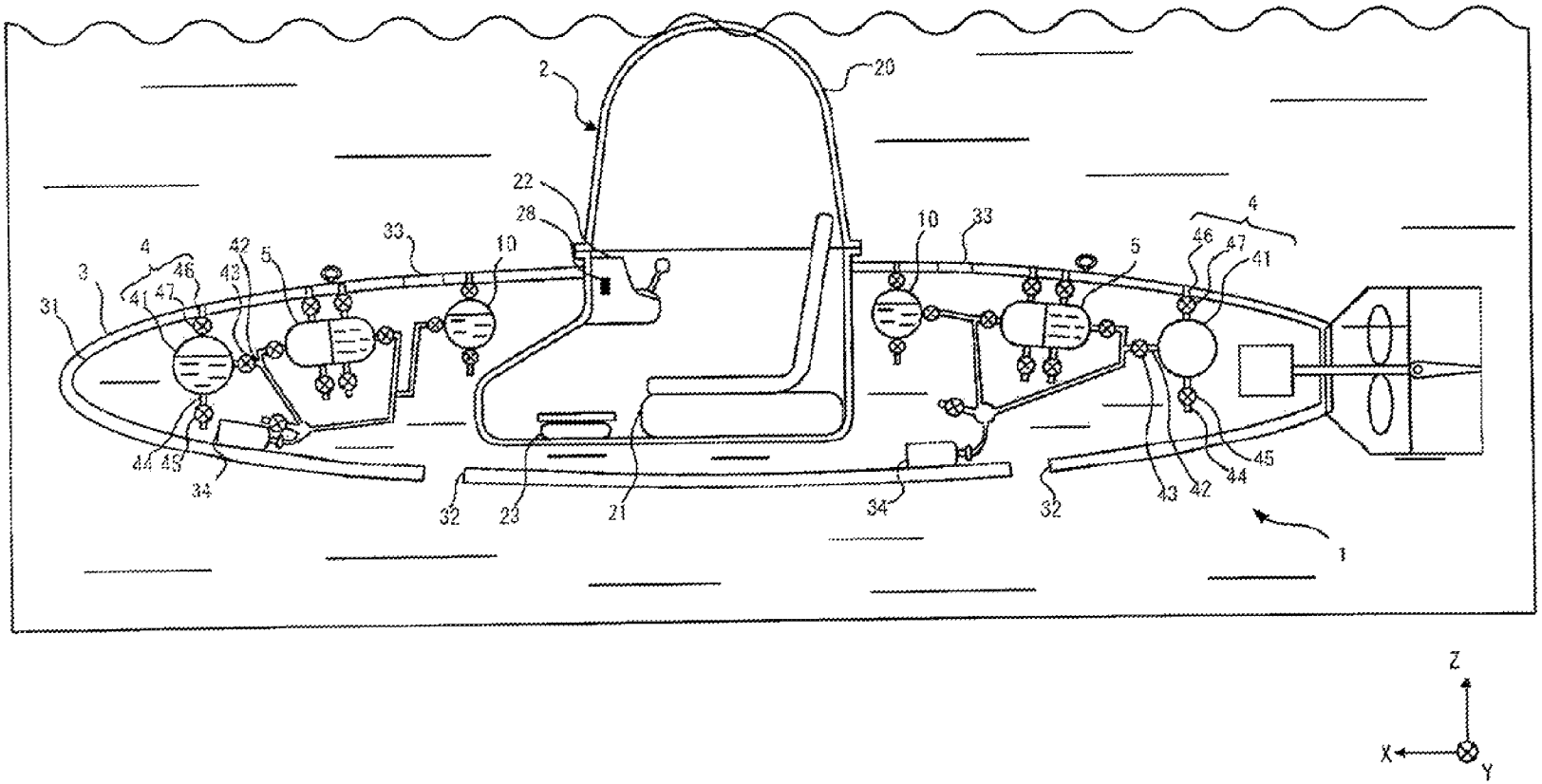
FIG. 5D is a diagram for explaining a case when the buoyancy of the submersible of the present invention equals 0.

When the control unit 28 determines that the current submergence depth equals the specified submergence depth, the control unit 28 switches the second air discharge valve 67 and the second water supply and discharge valve 65 to the closed state as shown in FIG. 5D to prevent the inflow of water into the buoyancy setting tank 61. The zero-buoyancy setting selected by the operator in the setting unit is automatically completed (S107). The control unit 28 then operates the screw 9, the rudder 8, the elevator 7, and the like in accordance with an operation made by the operator so as to move the submersible 1 in the sea.

Figure 6:
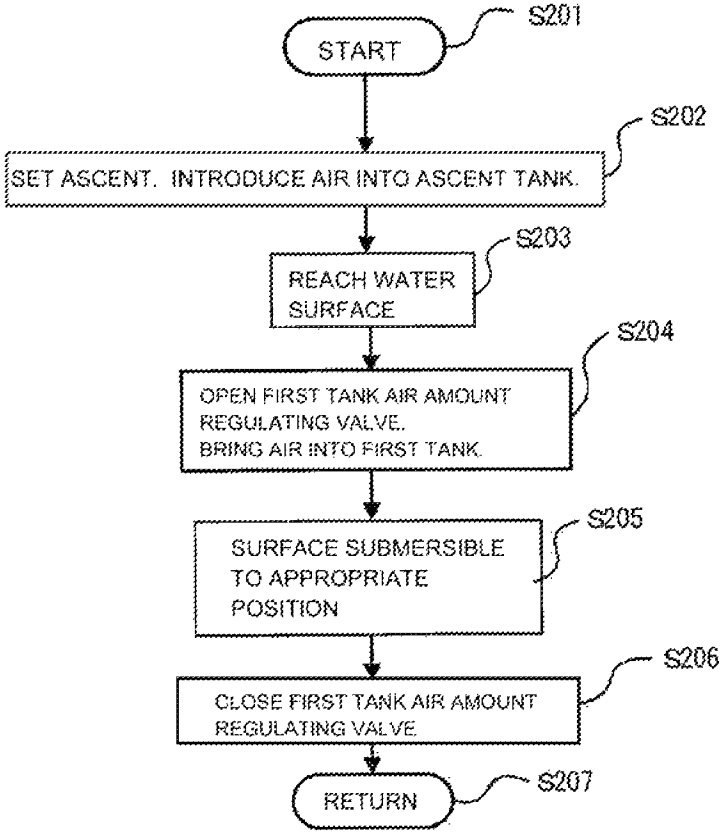
FIG. 6 is a flow chart used when the submersible of the present invention surfaces after a cruise.

A method of surfacing the submersible 1 with the use of the ascent and descent tanks will be described next with reference to a flow chart in FIG. 6. It is assumed that the cabin 2 and the descent tank 53 in the ascent and descent tank unit 5 are filled with air when the submersible 1 starts to surface. It is also assumed that the first tank 31 is filled with water and the second tank 41 contains both air and water.

Moreover, it is assumed that the vent 33, the first air discharge valve 47, the first water supply and discharge valve 45, the first air supply valve 43, the third air supply valve 524, the third water supply and discharge valve 522, the third air discharge valve 526, the fourth air supply valve 534, the fourth water supply and discharge valve 532 and the fourth air discharge valve 536, the second air discharge valve 67, the second water supply and discharge valve 65, and the second air supply valve 63 are each in the closed state (S20).

When the operator pushes an ascent switch in the setting unit of the operating unit 22 after the submersible 1 finishes the cruise in the water, the control unit 28 opens the third air supply valve 524 and the third water supply and discharge valve 522 to supply air into the ascent tank 52 and discharge water to the outside of the body 3 (S202).

This causes the weight of the submersible 1 to reduce and causes the buoyancy thereof to increase. Consequently, the submersible 1 ascends to a predetermined position where part of the submersible 1 appears above the sea surface (S203).

In order to further surface the submersible 1 after S203, the first tank air supply valve 49 is opened to discharge air into the first tank (S204), the submersible is thereby caused to surface to an appropriate position above the water surface (S205), the first tank air supply valve 49 is closed (S206), and the surfacing movement of the submersible 1 is completed (S207).

Processing regarding a submerging movement of the submersible 1, which is performed by the control unit 28 after the specified submergence depth is reached, will be described next.

Figure 7A:
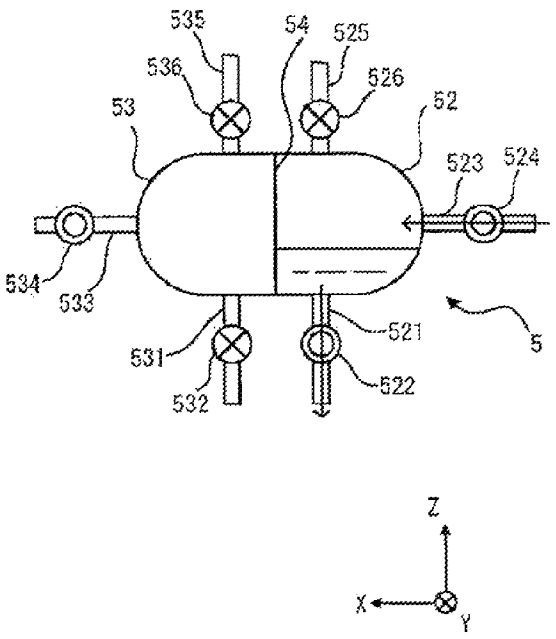
FIG. 7A is a diagram for explaining operations when the submersible of the present invention regulates an ascent and descent tank unit in the midst of submergence in order to ascend to a desired submergence depth.
Figure 7A:
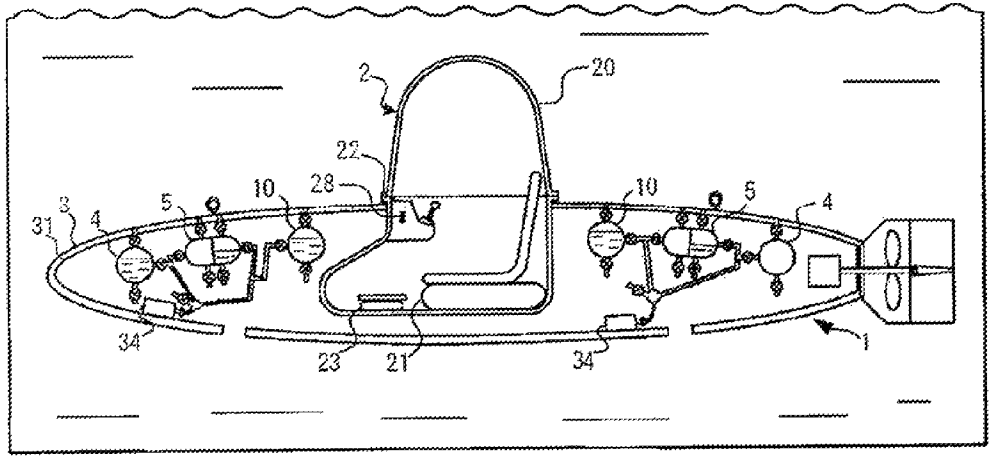
Figure 7B:
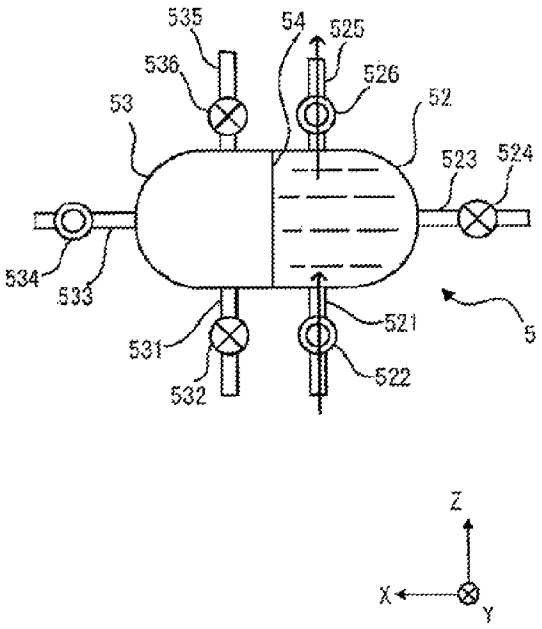
FIG. 7B is a diagram for explaining operations when the submersible of the present invention sets a neutral setting in the midst of submergence after being ascended to the desired submergence depth.
Figure 7B:
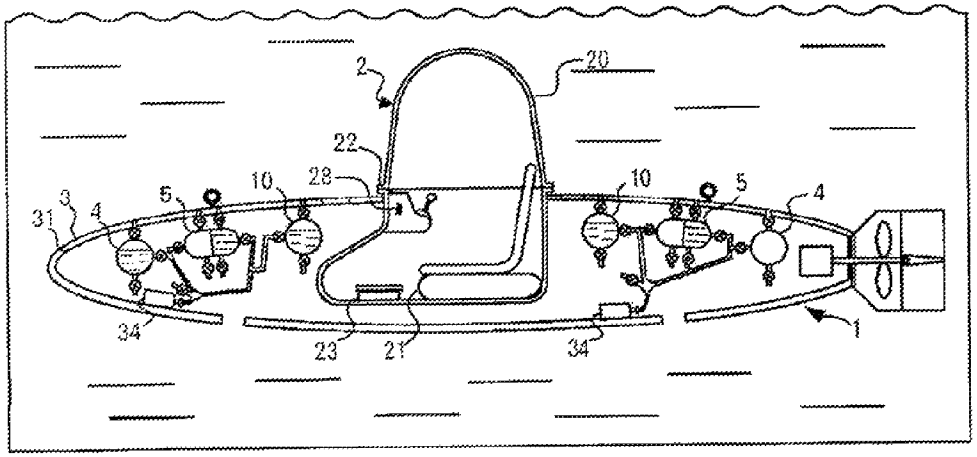
Figure 7C:
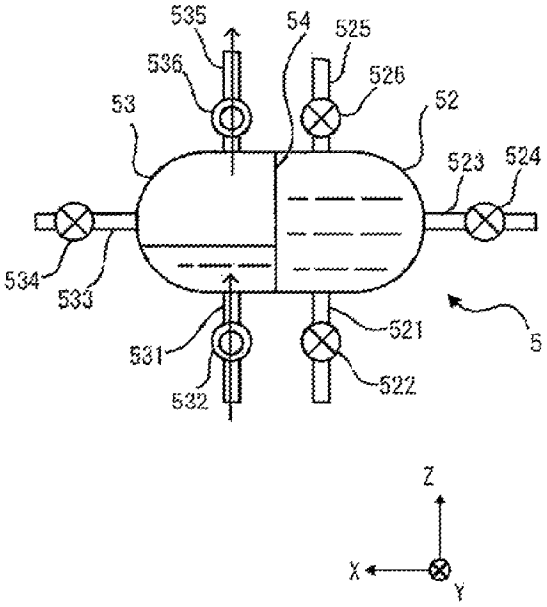
FIG. 7C is a diagram for explaining operations when the submersible of the present invention regulates the ascent and descent tank unit in the midst of submergence in order to submerge to a desired submergence depth.
Figure 7C:
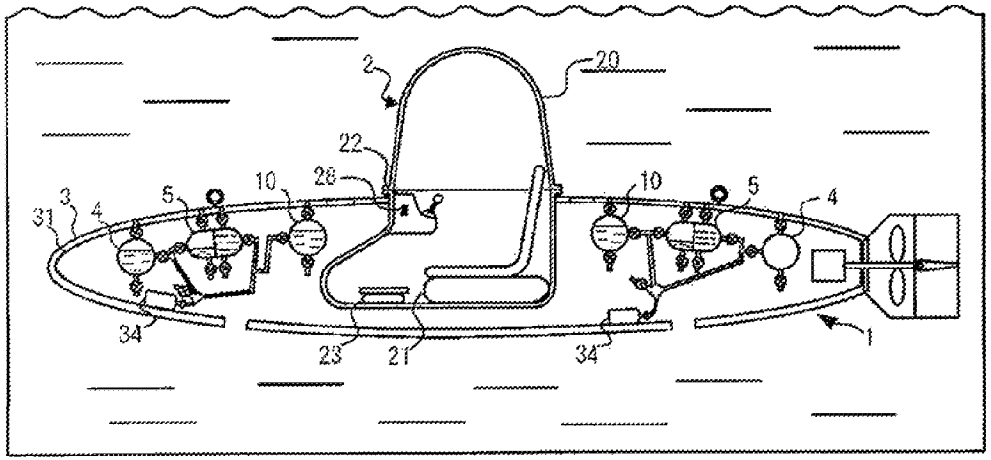

When the operator sets the descent setting in the setting unit of the operating unit 22 in the submersible 1 that has reached the specified submergence depth, the control unit 28 switches the fourth water supply and discharge valve 532 and the fourth air discharge valve 536 to the open state to cause water to flow into the descent tank 53 as shown in FIG. 7C.

Figure 7D:
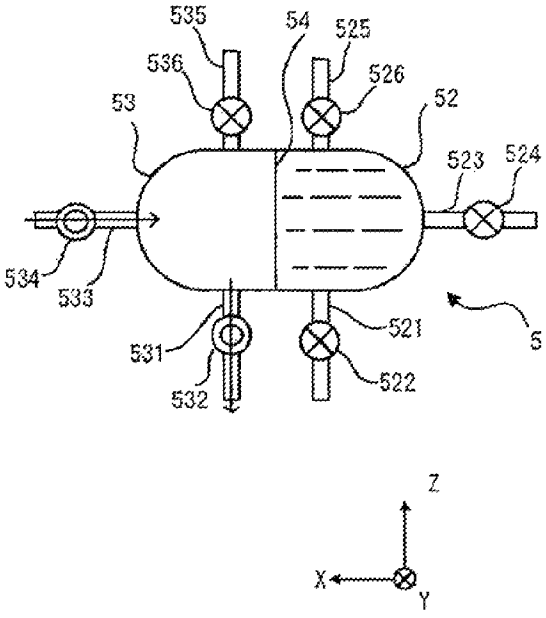
FIG. 7D is a diagram for explaining operations when the submersible of the present invention sets the neutral setting in the midst of submergence after being submerged to the desired submergence depth.
Figure 7D:
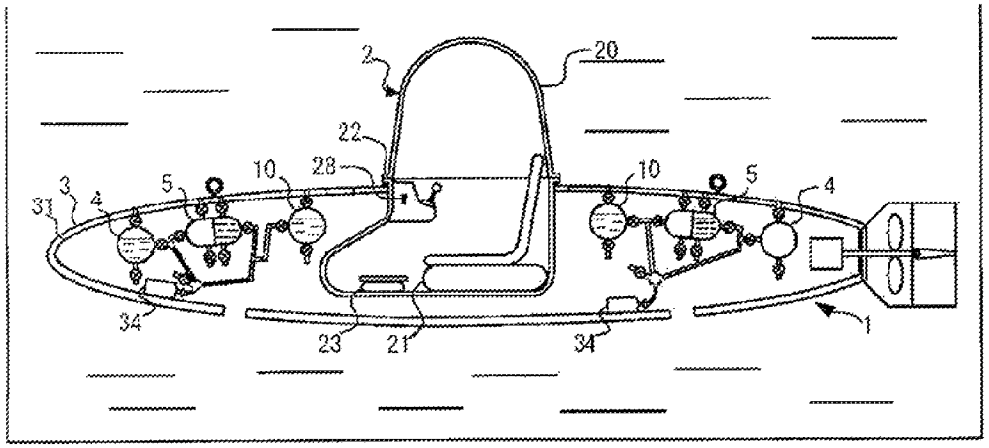

After the descent tank 53 is filled with water, the fourth water supply and discharge valve 532 and the fourth air discharge valve 536 are switched to the closed state to cause the submersible 1 to submerge. The operator checks the submergence depth displayed in the display unit. When the submersible 1 is submerged to the desired submergence depth, the operator operates the setting unit in the operating unit 22 to order the neutral setting. Consequently, the control unit 28 opens the fourth air supply valve 534 and the fourth water supply and discharge valve 532 to discharge water in the descent tank 53 and fill the descent tank 53 with air as shown in FIG. 7D.

After the descent tank 53 is filled with air, the control unit 28 switches the fourth air supply valve 534 and the fourth water supply and discharge valve 532 to the closed state to stop the submerging movement of the submersible 1.

In order to shallow the depth of the submersible in the midst of submergence, the ascent setting is set in the operating unit 22. When the ascent setting is set, the control unit 28 switches the third air supply valve 524 and the third water supply and discharge valve 522 to the open state to supply air into the ascent tank 52 and discharge water to the outside of the body 3. After the ascent tank 52 is filled with air, the third air supply valve 524 and the third water supply and discharge valve 522 are switched to the closed state to cause the submersible 1 to ascend.

When the operator determines that the submersible 1 has ascended to the desired submergence depth (after the setting of the ascent setting in the setting unit) by checking the submergence depth displayed in the display unit, the operator sets the neutral setting in the setting unit. When the control unit 28 determines that the neutral setting has been set in the setting unit, the control unit 28 opens the third water supply and discharge valve 522 and the third air discharge valve 526 to cause water to flow into the ascent tank 52 and put the ascent tank 52 in a watertight state as shown in FIG. 7B. After achieving the watertight state in the ascent tank 52, the control unit 28 closes the third water supply and discharge valve 522 and the third air discharge valve 526 to stop the ascending movement of the submersible 1.

As described above, the ascent and descent tank unit 5 used for regulation in changing the submergence depth of the submersible 1 after the submersible 1 reaches the desired submergence depth and the zero-buoyancy setting tank unit 10 used for regulation at the start of diving are separately provided. Thus, there is no need to operate the zero-buoyancy setting tank of the submersible 1 again in the submersible 1 after the desired depth is reached. Therefore, the submergence depth of the submersible 1 can be changed quickly and easily.

Figure 8:
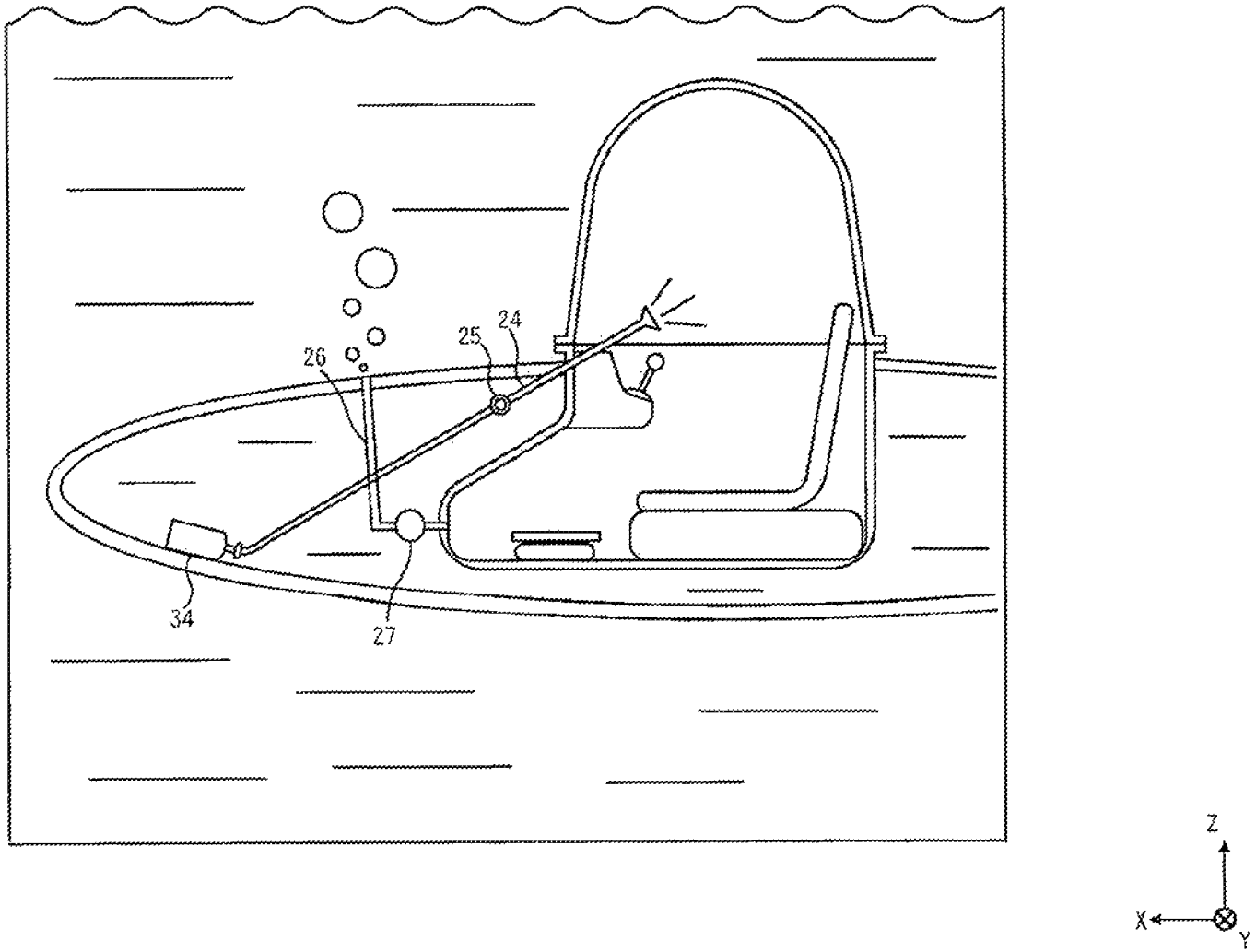
FIG. 8 is a schematic diagram illustrating an apparatus for discharging remaining old air in the cabin to the outside of the submersible and supplying fresh air according to the present invention.

In the above-described embodiment, the high-pressure air container 34 is connected only to the trim tank unit 4, the zero-buoyancy setting tank unit 10, and the ascent and descent tank unit 5. However, the high-pressure air container 34 may be connected to an air supply pipe 24 for supplying air into the cabin 2 as shown in FIG. 8.

According to the present submersible, the cabin 2 is designed to have a size just enough to accommodate a person in order to reduce the weight of the submersible. Therefore, fresh air needs to be fed in order to replenish for insufficient oxygen in the cabin 2. For this purpose, remaining old air in the cabin 2 is discharged to the outside of the body 3 from an area farthest from the mouth of the operator in the cabin 2 (e.g., a foot area of the operator) through an air discharge pipe 26 by means of an air compression pump 27. Since this causes air pressure in the cabin to lower, fresh air is supplied to a mouth area of the operator through the air supply pipe 24 while regulating the compressed air from the high-pressure air container 34 by an air pressure regulator 25 so that the air pressure in the cabin 2 always stays constant.

Although, in the above-described embodiment, the zero-buoyancy setting tank units 10 are disposed in front of and in the rear of the cabin 2 in the x-axis direction, respectively, the present invention is not particularly limited thereto. The zero-buoyancy setting tank unit 10 may be fixed at the center of the first tank 31 so that the level state of the submersible 1 can be maintained when the ascent, neutral, or descent setting is set.

Although the screw 9 is provided for moving the submersible 1 forward and backward in the above-described embodiment, the present invention is not particularly limited thereto. A water jet may be provided instead.

Moreover, although it is assumed in the above-described embodiment that only an operator is on board in the submersible 1, the present invention is not particularly limited thereto. A plurality of passengers may be on board in addition to the operator. In this case, the expansion container 212 for pushing up the seat 211 is provided under the seat 211 of each passenger, and water is poured into the expansion container 212 of each passenger according to the weight of the passenger. By doing so, losing the level balance of the submersible due to the weight differences among the passengers is prevented from occurring. However, the expansion container 212 may be at any place other than under the seat 211 as long as the expansion container 212 is in the cabin.

Such a configuration allows for the adjustment of the level balance and buoyancy of the submersible 1 by regulating an amount of water contained in the expansion container 212 in consideration of weights of an operator and passengers on board in the submersible 1.

In the submersible 1 of the above-described embodiment, when the submersible 1 is submerged to the specified submergence depth, the screw may be stopped and the third air supply valve and the third water supply and discharge valve may be opened to fill the ascent tank with air and thereby cause the submersible 1 to ascend in order to prevent further submergence beyond the specified submergence depth. Alternatively, an operator may be prohibited from selecting the descent setting in the setting unit when the submersible 1 reaches the specified submergence depth.

The present invention may be practiced in other various forms without departing from the spirit or major characteristics thereof. Therefore, it is to be understood that the aforementioned embodiments are only illustrative in every way and should not be construed as limiting the invention. The scope of the invention is indicated solely by the claims and is not bound by the description. Furthermore, all variations, various improvements, alternatives, and modifications belonging to the equivalent scope of the claims all fall within the scope of the present invention.

REFERENCE SIGNS LIST

1 submersible
2 cockpit
3 body
4 trim tank unit
5 ascent and descent tank unit
6 eyebolt
7 elevator
8 rudder
9 screw
10 zero-buoyancy setting tank unit
20 hatch
21 seat unit
22 operating unit
23 footrest unit
24 air supply pipe
25 air pressure regulator
26 air discharge pipe
27 air compression pump
28 control unit
31 first tank
32 flood hole
33 vent
34 high-pressure air container (air supply unit)
41 trim tank (second tank)
42 first air supply pipe
43 first air supply valve
44 first water supply and discharge pipe
45 first water supply and discharge valve
46 first air discharge pipe
47 first air discharge valve
48 first tank air supply pipe
49 first air supply valve
51 ascent and descent tank (fourth tank)

52 ascent sank (ascent tank)
53 descent tank (descent tank)
54 partition plate (partition wall)
61 third tank
62 second air supply pipe
63 second air supply valve
64 second water supply and discharge pipe
65 second water supply and discharge valve
66 second air discharge pipe
67 second air discharge valve
211 seat
212 expansion container
521 third water supply and discharge pipe
522 third water supply and discharge valve
523 third air supply pipe
524 third air supply valve
525 fourth air discharge pipe
526 third air discharge valve
531 fourth water supply and discharge pipe
532 fourth water supply and discharge valve
533 fourth air supply pipe
534 fourth air supply valve
535 fourth air discharge pipe
536 fourth air discharge valve

The invention claimed is:

1. A submersible comprising:

a cabin for boarding an operator;

a first tank constituting a body of the submersible and configured to lower buoyancy by inflow of water at the time of submergence;

a second tank disposed inside the first tank;

a first water supply and discharge pipe configured to allow water movement between an outside of the first tank and the second tank;

a first air supply pipe configured to allow air movement between an air supply unit for supplying air and the second tank;

a third tank disposed inside the first tank;

a second water supply and discharge pipe configured to allow water movement between the outside of the first tank and the third tank;

a second air supply pipe configured to allow air movement between the air supply unit for supplying air and the third tank;

a fourth tank disposed inside the first tank and having an ascent tank and a descent tank;

a third water supply and discharge pipe configured to allow water movement between the outside of the first tank and the ascent tank;

a third air supply pipe configured to allow air movement between the air supply unit and the ascent tank;

a fourth water supply and discharge pipe configured to allow water movement between the outside of the first tank and the descent tank; and a fourth air supply pipe configured to allow air movement between the air supply unit and the descent tank.

2. The submersible according to claim 1, wherein the second tank is provided both in front of and in the rear of the cabin.

3. The submersible according to claim 1, wherein the cabin includes an expansion container for adjusting an air amount in the cabin by inflow or discharge of water thereinto or therefrom, and the expansion container contracts according to a weight increase of an operator on board and the expansion container expands according to a weight decrease of an operator on board.

4. The submersible according to claim 3, wherein the cabin includes an operating unit operated by the operator and a seat unit to be seated by the operator, and the seat unit includes a seat and the expansion container.

5. The submersible according to claim 4, wherein water corresponding to a difference between a design maximum operator's weight and a weight of an operator is poured into the expansion container when causing the submersible to submerge so that buoyancy of the submersible equals buoyancy when an operator having the design maximum operator's weight is on board, and an expansion state of the expansion container is adjusted so that a height of the seat unit is larger when a lighter operator is on board than when a heavier operator is on board.

6. The submersible according to claim 1, comprising:

an apparatus for replenishing for insufficient oxygen in the cabin by compressing remaining old air by an air compression pump and discharging the compressed air to an outside of the submersible from a foot area of an operator in the cabin and supplying fresh air to a mouth of the operator from an air supply pipe through an air pressure regulator.

7. The submersible according to claim 1, comprising:

a first water supply and discharge valve for regulating a water amount moved from the outside of the first tank to the second tank via the first water supply and discharge pipe;

a first air supply valve for regulating an air amount moved from the air supply unit to the second tank via the first air supply pipe;

a second water supply and discharge valve for regulating a water amount moved from the outside of the first tank to the third tank via the second water supply and discharge pipe;

a second air supply valve for regulating an air amount moved from the air supply unit to the third tank via the second air supply pipe;

a third water supply and discharge valve for regulating a water amount moved from the outside of the first tank to the ascent tank via the third water supply and discharge pipe;

a third air supply valve for regulating an air amount moved from the air supply unit to the ascent tank via the third air supply pipe;

a fourth water supply and discharge valve for regulating a water amount moved from the outside of the first tank to the descent tank via the fourth water supply and discharge pipe; and a fourth air supply valve for regulating an air amount moved from the air supply unit to the descent tank via the fourth air supply pipe.

8. The submersible according to claim 7, wherein the ascent tank is filled with water and the descent tank is filled with gas at the start of submergence.

9. A method of controlling the submersible according to claim 8, wherein the submersible further comprises a setting unit by which an operator can selectively set any one of an ascent setting for causing the submersible to surface, a descent setting for causing the submersible to descend, and a neutral setting for preventing an ascending movement and a descending movement of the submersible, when an operator sets the descent setting in the setting unit in order to cause the submersible to submerge to a desired submergence depth, a fourth air discharge valve in the descent tank is opened and the fourth water supply and discharge valve is opened to discharge air in the descent tank and to cause water to flow into and fill the descent tank, when an operator sets the neutral setting in the setting unit after the submersible reaches the desired submergence depth, the control unit closes the fourth air discharge valve and opens the fourth air supply valve to cause air to flow into the descent tank for discharging water from the descent tank through the fourth water supply and discharge pipe and filling the descent tank with air, and then closes the fourth water supply and discharge valve and the fourth air supply valve, and when an operator sets the ascent setting in the setting unit after the neutral setting is set, the control unit opens the third water supply and discharge valve and the third air supply valve to push out water in the ascent tank from the third water supply and discharge pipe and fill the ascent tank with air, and then closes the third water supply and discharge valve and the third air supply valve.

* * * * *